US011780196B2

(12) United States Patent
Giovanneschi et al.

(10) Patent No.: US 11,780,196 B2
(45) Date of Patent: Oct. 10, 2023

(54) LINE FOR THE PRODUCTION OF COVERED CARDBOARD BOXES

(71) Applicant: EMMECI S.P.A., Cerreto Guidi (IT)

(72) Inventors: Alessio Giovanneschi, Montopoli in Val D'Arno (IT); Pablo Baroni, Vicopisano (IT)

(73) Assignee: EMMECI S.P.A., Cerreto Guidi (IT)

( * ) Notice: Subject to any disclaimer, the term of this patent is extended or adjusted under 35 U.S.C. 154(b) by 0 days.

(21) Appl. No.: 17/391,954

(22) Filed: Aug. 2, 2021

(65) Prior Publication Data

US 2021/0362454 A1 Nov. 25, 2021

Related U.S. Application Data

(62) Division of application No. 16/177,522, filed on Nov. 1, 2018, now Pat. No. 11,104,094.

(30) Foreign Application Priority Data

Nov. 16, 2017 (IT) ..... 102017000131292

(51) Int. Cl.
*B31B 50/04* (2017.01)
*B31B 50/00* (2017.01)
(Continued)

(52) U.S. Cl.
CPC ..... *B31B 50/044* (2017.08); *B31B 50/005* (2017.08); *B31B 50/006* (2017.08);
(Continued)

(58) Field of Classification Search
None
See application file for complete search history.

(56) References Cited

U.S. PATENT DOCUMENTS 2,645,365 A 7/1953 Haessler
2,867,158 A * 1/1959 Andresen, Jr. ..... B31B 50/81 493/111
(Continued)

FOREIGN PATENT DOCUMENTS

EP 0 685 329 A2 5/1995
EP 685329 A2 * 12/1995 ..... B31B 50/00

OTHER PUBLICATIONS

Ministero dello Sviluppo Economico, Search Report issued in IT 201700131292 (7pgs).

*Primary Examiner* — Tanzim Imam
(74) *Attorney, Agent, or Firm* — Wentsler LLC

(57) ABSTRACT

A line and method for the production of covered cardboard boxes are disclosed. The line includes a conveyor unit including a belt and a conveyor actuator that drives the belt intermittently in an alternating sequence of movements and stops. A feed unit individually feeds covering blanks from a reservoir to the conveyor unit in a sequence of feed instants. An erecting machine folds box blanks into corresponding boxes. A positioner individually positions the boxes from the erecting machine, in alignment on corresponding covering blanks disposed on the belt of the conveyor unit. A gluer spreads glue on one face of the covering blanks. A covering machine folds the covering blanks into contact with their respective boxes to cover the boxes. A control unit connected to the feed unit adjustably sets a phase displacement of the feed instants relative to the sequence of stops of the belt.

17 Claims, 12 Drawing Sheets

(51) Int. Cl.

| | |
|---|---|
| ***B31B 50/26*** | (2017.01) |
| ***B31B 50/74*** | (2017.01) |
| ***B31B 50/07*** | (2017.01) |
| ***B31B 50/62*** | (2017.01) |
| *B31B 120/50* | (2017.01) |
| *B31B 105/00* | (2017.01) |
| *B31B 110/35* | (2017.01) |

(52) U.S. Cl.

CPC ..... *B31B 50/042* (2017.08); *B31B 50/07* (2017.08); *B31B 50/26* (2017.08); *B31B 50/624* (2017.08); *B31B 50/742* (2017.08); *B31B 2105/001* (2017.08); *B31B 2110/35* (2017.08); *B31B 2120/50* (2017.08)

(56) References Cited

U.S. PATENT DOCUMENTS

| | | | | |
|---|---|---|---|---|
| 3,961,784 | A * | 6/1976 | Sevak | G06K 13/107 271/34 |
| 5,451,795 | A | 9/1995 | Carbrey et al. | |
| 6,763,931 | B1 * | 7/2004 | Brehm | B65G 47/31 198/460.1 |
| 7,635,124 | B2 * | 12/2009 | Sardella | B65H 3/126 271/99 |
| 2005/0189703 | A1 * | 9/2005 | Okazaki | B65H 29/30 271/207 |
| 2015/0259144 | A1 * | 9/2015 | Hershfeld | B65H 7/02 198/689.1 |
| 2018/0009189 | A1 * | 1/2018 | Ronquist | B31F 1/0022 |
| 2019/0143627 | A1 | 5/2019 | Giovanneschi et al. | |

* cited by examiner

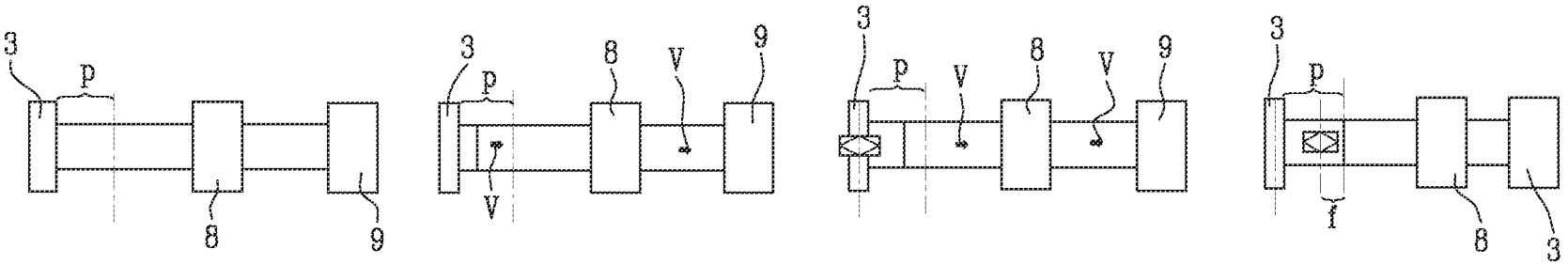
Fig.7B
Fig.7C
Fig.7D
Fig.7E
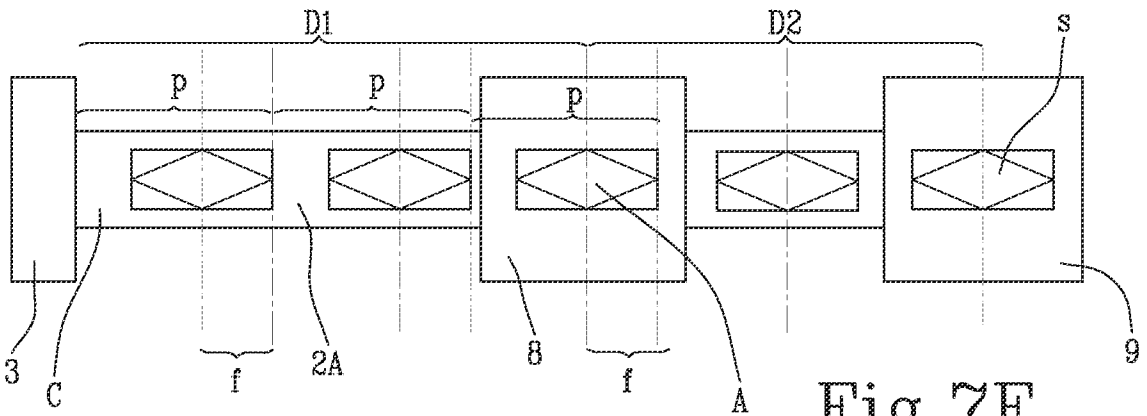
Fig.7F

LINE FOR THE PRODUCTION OF COVERED CARDBOARD BOXES

BACKGROUND OF THE INVENTION

1. Technical Field of the Invention

This invention relates to a line for the production of covered cardboard boxes. A machine for making covered cardboard boxes is a machine which makes boxes with a high quality finish from a box blank and a covering blank. More specifically, a line for making covered boxes, hereinafter referred to simply as "line", comprises a conveyor belt which directs the materials being processed from one station to another of the line. The line comprises a first feed station, where the covering blanks are picked up and fed to the belt. The covering blanks are withdrawn from a reservoir and fed to a main section of the belt. While the covering blank is being fed, a gluer spreads glue on the face of it which will come into contact with the box blank. The covering blank is then transferred as far as a positioner.

The line comprises a second feed station, where the box blanks are picked up and fed to a second section of the belt.

The box blanks reach and are held in a quadrangular frame in which the blank is folded to give it its final shape.

After being folded, the box blanks are conveyed to the positioner, where the second section of the belt merges into the main section. In the positioner, the covering blank and the box are aligned. From the positioner, the box and the respective covering blank are transferred to a covering machine. The covering machine folds the covering blank onto the box, thereby completing the process cycle of the line. Next, the belt conveys the covered box to an unloading station.

The main section is driven by a conveyor actuator. The conveyor actuator operates intermittently. More specifically, the conveyor actuator has transporting intervals, in which the covering blanks and the boxes with the respective covering blanks are effectively made to move forward along the main section of the belt, and idle intervals in which positioning or covering operations are performed in the positioner and in the covering machine, respectively.

The belt movement step is a function of the peripheral speed of the belt and the movement period. Where the dimensions and features of the batch being made are the same, the belt movement step is generally kept constant for convenience of programming the actuators. To enable the machine to work continuously, however, it is important that the distance between the covering blank feed station and the positioner be a multiple or a submultiple of the distance between the positioner and the covering machine. This guarantees that the line will never have any position where the two processes are not simultaneous, thus significantly increasing the productivity of the machine.

Thus, for batch processing flexibility without affecting productivity, it is of fundamental importance to be able to adapt the mutual distance between the first feed station, the positioner and the covering machine as a function of the dimensions of the batch, which determine a minimum spacing corresponding to maximum productivity.

2. Description of Related Art

Known in the sector are lines for making covered boxes where changeover can be carried out by moving the positioner along a direction of maximum extension of the belt. In other words, a slide on the line frame allows the positioner to be translated along the main section of the belt so as to vary the mutual distance between the first feed station, the positioner and the covering machine. Varying the mutual distances allows adapting the line in such a way that the distance between the first feed station and the positioner is a multiple or sub-multiple of the distance between the positioner and the covering machine.

This solution, however, has serious drawbacks in terms of overall dimensions. A line made in this way is anything but compact, has very long changeover times and, above all, requires considerable power to move the heavy weights of the machine parts involved.

To reduce power requirements, the structure has been made more flexible and hence, more subject to vibrations, with the result that processes are less precise.

Other examples of lines for processing cardboard boxes are provided in patent documents EP0685329, U.S. Pat. Nos. 2,867,158 and 6,763,931. However, also these examples fail to overcome the aforementioned drawbacks.

BRIEF SUMMARY OF THE INVENTION

This invention has for an aim to provide a line for making covered cardboard boxes to overcome the above mentioned disadvantages of the prior art.

More specifically, this invention has for an aim to provide a line for making covered cardboard boxes capable of particularly rapid and efficient changeovers.

This aim is fully achieved by the line for making covered cardboard boxes according to this disclosure as characterized in the appended claims.

According to one aspect of this disclosure, this invention provides a line for making covered cardboard boxes.

In one embodiment, the line comprises a conveyor unit. The conveyor unit is thus defined because it is configured to convey semi-finished products along the line from one position on the line to another position on the line. In one embodiment, the conveyor unit comprises a conveyor means. In one embodiment, the conveyor means is a belt. In one embodiment, the conveyor means is a set of rollers in series. In one embodiment, the belt is movable to transport a plurality of covering blanks from a loading position to an unloading position. By loading position is meant the position where processing of the covering blanks along the line starts. By unloading position is meant the position where processing of the covering blanks along the line stops.

In one embodiment, the conveyor unit comprises a conveyor actuator. In one embodiment, the conveyor actuator is connected to the belt to drive it. In one embodiment, the conveyor actuator is connected to the belt to drive it intermittently, in an alternating sequence of movements and stops.

In one embodiment, the line comprises a feed unit.

In one embodiment, the feed unit is configured to pick up the covering blanks from a reservoir. In one embodiment, the feed unit is configured to feed the covering blanks individually to the conveyor unit at the loading position, in a sequence of feed instants.

It should be noted that the sequence of feed instants corresponds to the sequence of forward movements, since for each forward movement (that is, for each stop) of the belt, the line (specifically, the feed unit) feeds a new covering blank onto the belt.

In one embodiment, the feed unit comprises a picker configured to pick up the covering blanks from a reservoir and place them at a pre-feed position ready for feeding. In one embodiment, the feed unit comprises a feeder configured to pick up the covering blanks from the pre-feed position and to feed them individually to the conveyor unit at the loading position, according to the sequence of feed instants.

In one embodiment, the line comprises an erecting machine. In one embodiment, the erecting machine is configured to receive the cardboard box blanks. In one embodiment, the erecting machine is configured to fold the box blanks and to form corresponding cardboard boxes.

In one embodiment, the line comprises a positioner. In one embodiment, the positioner is configured to receive the boxes from the erecting machine. In one embodiment, the positioner is configured to receive the boxes from the erecting machine and position them individually in alignment on corresponding covering blanks disposed on the belt of the conveyor unit, at a coupling position interposed between the loading position and the unloading position.

In one embodiment, the line comprises a gluer. In one embodiment, the gluer is configured to spread glue on one face of the covering blanks which will come into contact with a corresponding surface of the boxes to be covered.

In one embodiment, the line comprises a covering machine. In one embodiment, the covering machine is configured to receive the boxes coupled to the respective covering blanks from the conveyor unit at the unloading position. In one embodiment, the covering machine is configured to fold the covering blank into contact with the respective box in such a way as to cover it.

In one embodiment, the line comprises a control unit.

In one embodiment, the control unit is connected to the feed unit. In one embodiment, the control unit is connected to the feed unit to set a phase displacement of the feed instants relative to the sequence of stops of the belt. In one embodiment, the control unit is connected to the feed unit to adjustably set a phase displacement of the feed instants relative to the sequence of stops of the belt.

In one embodiment, the control unit is connected to the feed unit to adjustably set a phase displacement of the feed instants and the corresponding movement instants of the belt.

In one embodiment, the control unit is connected to the feed unit, to adjustably set a phase displacement of the feed instants relative to the corresponding movement instants of the belt.

In one embodiment, the control unit is programmed to receive format data, representing (correlated to) a format (i.e. a shape and/or size) of the covering blanks.

In one embodiment, the control unit is programmed to set working data as a function of (responsive to) the format data; said working data represent (are indicative of) a sequence of movements and/or stops of the belt (and/or of the feed instants).

Hence, the feed unit is capable to feed the blanks at instants when the belt is moving.

By phase displacement is meant a time delay or advance between the feed instants and the activating of the conveyor actuator which moves the belt forward.

The phase displacement set by the control unit allows the line to considerably speed up changeover. In effect, when the dimensions of the batches to be processed vary, the control unit sets the time phase displacement in such a way as to virtually reduce or increase the distance of the feed unit from the positioner, increasing or delaying the feed instants. Changeover thus occurs rapidly and above all without moving heavy weights.

In one embodiment, the line comprises a feed actuator.

In another embodiment, the feed actuator is distinct from the conveyor actuator. In one embodiment, the feed unit is connected to the control unit. In one embodiment, the feed actuator is connected to the feed unit to drive it according to the sequence of feed instants. This allows the control unit to drive two separate actuators and to easily set the phase displacement between the feed instants and the stops of the belt.

In one embodiment, the control unit is programmed to activate the feed actuator. In one embodiment, the control unit is programmed to activate the feed actuator and the conveyor actuator in a synchronous and phase-displaced manner according to the phase displacement of the feed instants relative to the corresponding stops of the belt.

This makes it possible, once the phase displacement has been set, to have a feed period and a movement period which are the same.

In one embodiment, the feed actuator coincides with the conveyor actuator.

In this embodiment, the conveyor actuator is connected to the feed unit. In this embodiment, the line may comprise a mechanical variation unit. By mechanical variation unit is meant a set of elements configured to implement the phase displacement between the feed instants and the sequence of stops of the belt, set mechanically by the control unit.

In one embodiment, the variation unit comprises a selector configured to couple or uncouple a first transmission shaft which is integral with the conveyor actuator and a second transmission shaft which is integral with the feed unit.

In another embodiment, the variation unit comprises an adjustable engagement clutch configured to transmit motion to the second transmission shaft after a certain time instant, proportional to the phase displacement.

In another embodiment, the variation unit comprises a cam profile configured to transmit motion to the second transmission shaft after a certain time instant, proportional to the phase displacement.

In one embodiment, the control unit is programmed to activate the feed actuator in a sequence of instants temporally located in respective time intervals in which the belt is in motion. In other words, on a time line, each feed instant of the sequence of feed instants is simultaneous with the forward movement of the belt.

In one embodiment, the control unit is connected to the conveyor actuator to vary the sequence of movements and stops of the belt. This allows the control unit to perform changeover by varying the parameters of the conveyor actuator.

In one embodiment, the control unit is programmed to receive format data representing a format of the covering blanks. In one embodiment, the format data might also represent other parameters such as, by way of non-limiting example, the type of material or its shear strength.

In one embodiment, the control unit is programmed to set working data representing the sequence of movements and stops of the belt as a function of the format data. By working data is meant the set of data which characterizes a working cycle, together with all the operations and all the movements performed on a box blank and on a covering blank to obtain a covered box. More specifically, in one embodiment, the working data may include specifications regarding the belt, the conveyor actuator, the feed unit, the erecting machine or the covering machine.

In one embodiment, the working data include the phase displacement of the feed instants relative to the sequence of stops of the belt. In one embodiment, the working data include one or more of the following parameters:

a working spacing, defined by a distance between two consecutive covering blanks disposed on the belt, measured in a direction of maximum extension of the belt;

a belt speed;

a duration of belt stops;

a stop/move repetition period;

a working time on the covering machine;

a working time on the erecting machine;

a working time on the positioner.

In one embodiment, the belt of the conveyor unit is configured to hold the covering blanks by suction.

In one embodiment, the belt comprises a first suction zone. In one embodiment, the first suction zone is adjacent to the feed unit. In one embodiment, the belt is configured to apply a first suction force at the first suction zone.

In one embodiment, the belt comprises a second suction zone. In one embodiment, the second suction zone is spaced from the feed unit. In one embodiment, the belt is configured to apply a second suction force at the second suction zone.

In one embodiment, the second suction force is smaller than the first suction force.

This feature of the belt is very important because it allows the covering blanks to be fed on the fly without them losing their adherence to the belt. Adherence is very important because it prevents creases on the covering blank which could lead to serious quality defects in the finished box.

According to one aspect of this disclosure, this invention provides a method for making covered cardboard boxes.

In one embodiment, the method comprises a step of conveying a plurality of covering blanks.

In one embodiment, the method comprises a step of intermittently conveying a plurality of covering blanks. The step of intermittently conveying occurs from a loading position to an unloading position. In one embodiment, the step of intermittently conveying occurs through a conveyor unit including a belt which is driven intermittently by a conveyor actuator in an alternating sequence of movements and stops.

In one embodiment, the method comprises a step of picking up covering blanks. The covering blanks are picked up individually from a reservoir in which they are stored ready for processing.

In one embodiment, the method comprises a step of feeding the covering blanks individually to the loading position of the belt by means of a feed unit, in a sequence of feed instants.

In one embodiment, the method comprises a step of receiving box blanks in an erecting machine. In one embodiment, the method comprises a step of folding the box blanks to form corresponding boxes.

In one embodiment, the method comprises a step of positioning each box in alignment on a corresponding covering blank disposed on the belt, at a coupling position interposed between the loading position and the unloading position.

In one embodiment, the method comprises a step of spreading glue on one face of the covering blanks which will come into contact with a corresponding surface of the boxes to be covered.

In one embodiment, the method comprises a step of conveying the boxes coupled to the respective covering blanks as far as the unloading position on the belt by means of the conveyor unit.

In one embodiment, the method comprises a step of feeding the boxes coupled to the respective covering blanks to a covering machine. In one embodiment, the covering machine folds the covering blanks into contact with the respective box in such a way as to cover the box.

In one embodiment, the method comprises a step of adjustably setting, by means of a control unit, a phase displacement of the feed instants relative to the sequence of stops of the belt.

In one embodiment, the method comprises a step of adjustably setting, by means of a control unit, a phase displacement of the feed instants relative to the corresponding movement instants of the belt.

In other words, the control unit displaces the feed instants of the covering blank relative to the time intervals in which the belt is in motion.

In one embodiment, the method comprises a step of changeover. In one embodiment, the step of changeover comprises a step of varying in which the control unit varies the sequence of movements and stops of the belt.

In one embodiment, the method comprises a step of processing. In one embodiment, in the step of processing, the control unit receives format data representing a format of the covering blanks. In one embodiment, the step of processing comprises a step of setting working data, representing a working cycle, defined as the set of operations and movements performed on a covering blank and on a box blank to obtain a covered box.

In one embodiment, the step of processing comprises a step of setting the sequence of movements and stops of the belt as a function of the format data. In one embodiment, the step of setting comprises setting one or more of the following parameters:

a working spacing, defined by a distance between two consecutive covering blanks disposed on the belt, measured in a direction of maximum extension of the belt;

a belt speed;

a duration of belt stops;

a stop/move repetition period;

a working time on the covering machine;

a working time on the erecting machine;

a working time on the positioner.

In one embodiment, in which the line comprises a feed actuator which is distinct from the conveyor actuator, the step of feeding a single covering blank is performed by means of the feed unit driven by the feed actuator. In this embodiment, the control unit displaces the feed instants relative to the sequence of stops of the belt by displacing the instants at which two distinct signals are sent, one directed to the conveyor actuator and the other directed to the feed actuator.

In one embodiment, the control unit activates the feed actuator and the conveyor actuator in a synchronous and phase-displaced manner as a function of the phase displacement of the feed instants relative to the corresponding stops of the belt.

In one embodiment, in which the conveyor actuator and the feed actuator coincide, the method comprises a step of mechanical displacement. In one embodiment, in the step of mechanical displacement, a variation unit displaces an instant at which the motion of the conveyor actuator reaches the feed unit relative to an instant at which the motion reaches the belt.

In one embodiment, the step of feeding the covering blanks to the loading position is performed with the belt of the conveyor unit in motion. In other words, the step of feeding the covering blanks to the loading position of the belt is performed during a move interval of the belt.

In other words, the control unit activates the feed actuator when the belt is in motion.

In the embodiment in which the line comprises a feed actuator which is distinct from the conveyor actuator, the feed actuator is active when the conveyor actuator is active.

In one embodiment, the method comprises a step of applying suction in which the belt applies a suction force on the covering blank disposed thereon.

In one embodiment, the step of applying suction comprises a first step of applying suction. In the first step of applying suction, a first suction zone is adjacent to the feed unit. In one embodiment, in this first step of applying suction, the first suction zone applies a first suction force on the covering blanks.

In one embodiment, the step of applying suction comprises a second step of applying suction. In the second step of applying suction, a second suction zone is spaced from the feed unit. In one embodiment, in this second step of applying suction, the second suction zone applies a second suction force on the covering blanks.

In one embodiment, the second suction force is smaller than the first suction force. This allows the covering blank to remain adherent to the belt during the step of feeding which, because it is carried out on the fly, presents some critical aspects.

BRIEF DESCRIPTION OF THE DRAWINGS

This and other features will become more apparent from the following description of a preferred embodiment, illustrated by way of non-limiting example in the accompanying drawings, in which:

FIG. 7B schematically illustrates the line of FIG. 1 at the instant of time, labelled "$t_0$" in FIG. 7A, where "$t_0$" indicates a starting instant at which there are still no blanks on the belt;

FIG. 7C schematically illustrates the line of FIG. 1 at the instant of time, labelled "$t_0$+s" in FIG. 7A;

FIG. 7D schematically illustrates the line of FIG. 1 at the instant of time, labelled "$t_0$+s+$T_f$" in FIG. 7A;

FIG. 7E schematically illustrates the line of FIG. 1 at the instant of time, labelled "ts" in FIG. 7A;

FIG. 7F schematically illustrates the line of FIG. 1 at the instant of time, labelled "$t_r$" in FIG. 7A, where "$t_r$" indicates an instant of time in which line operation is at steady state.

DETAILED DESCRIPTION

Figure 1:
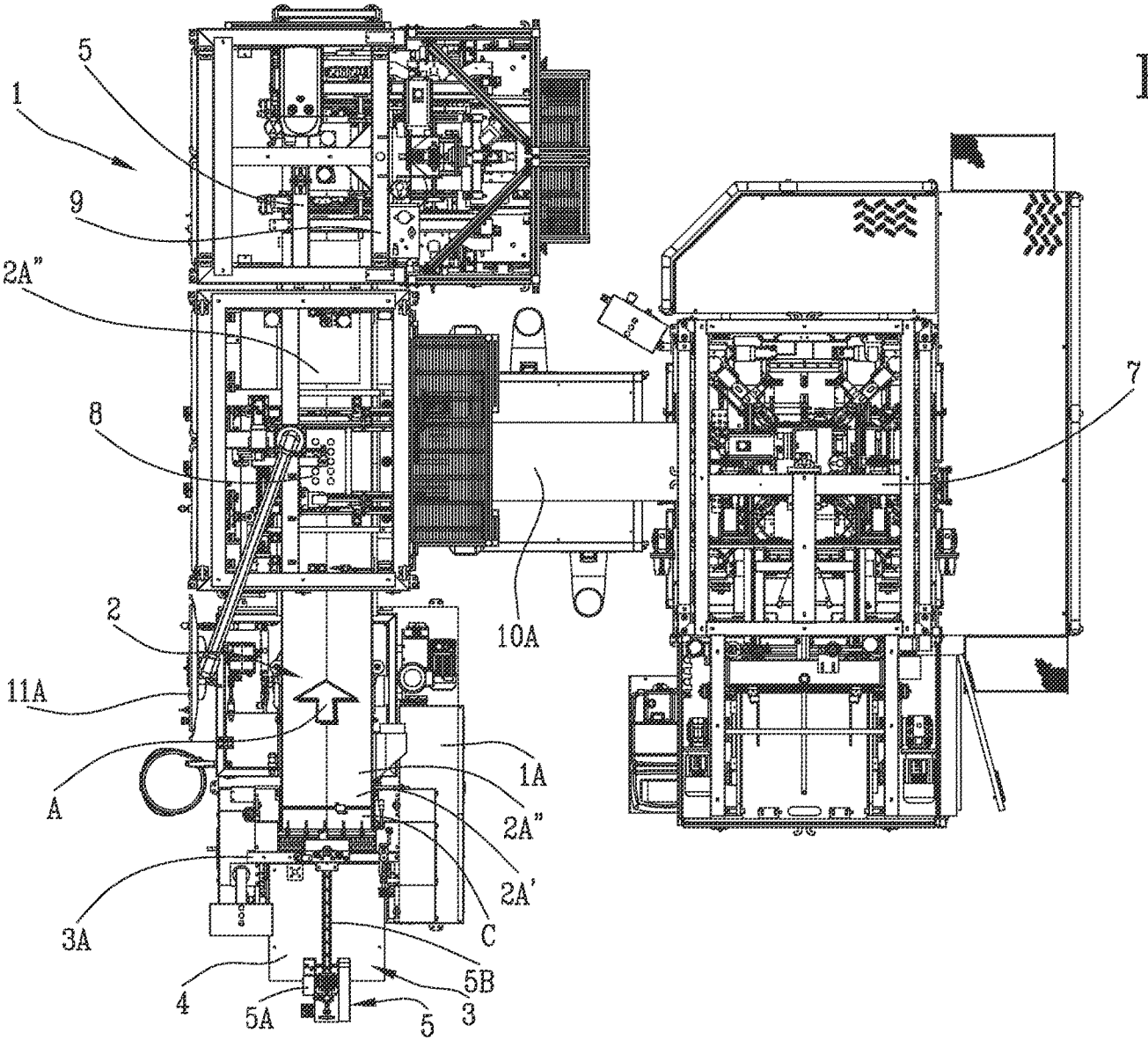
FIG. 1 is a plan view of a line for the production of covered cardboard boxes.
Figure 1A:
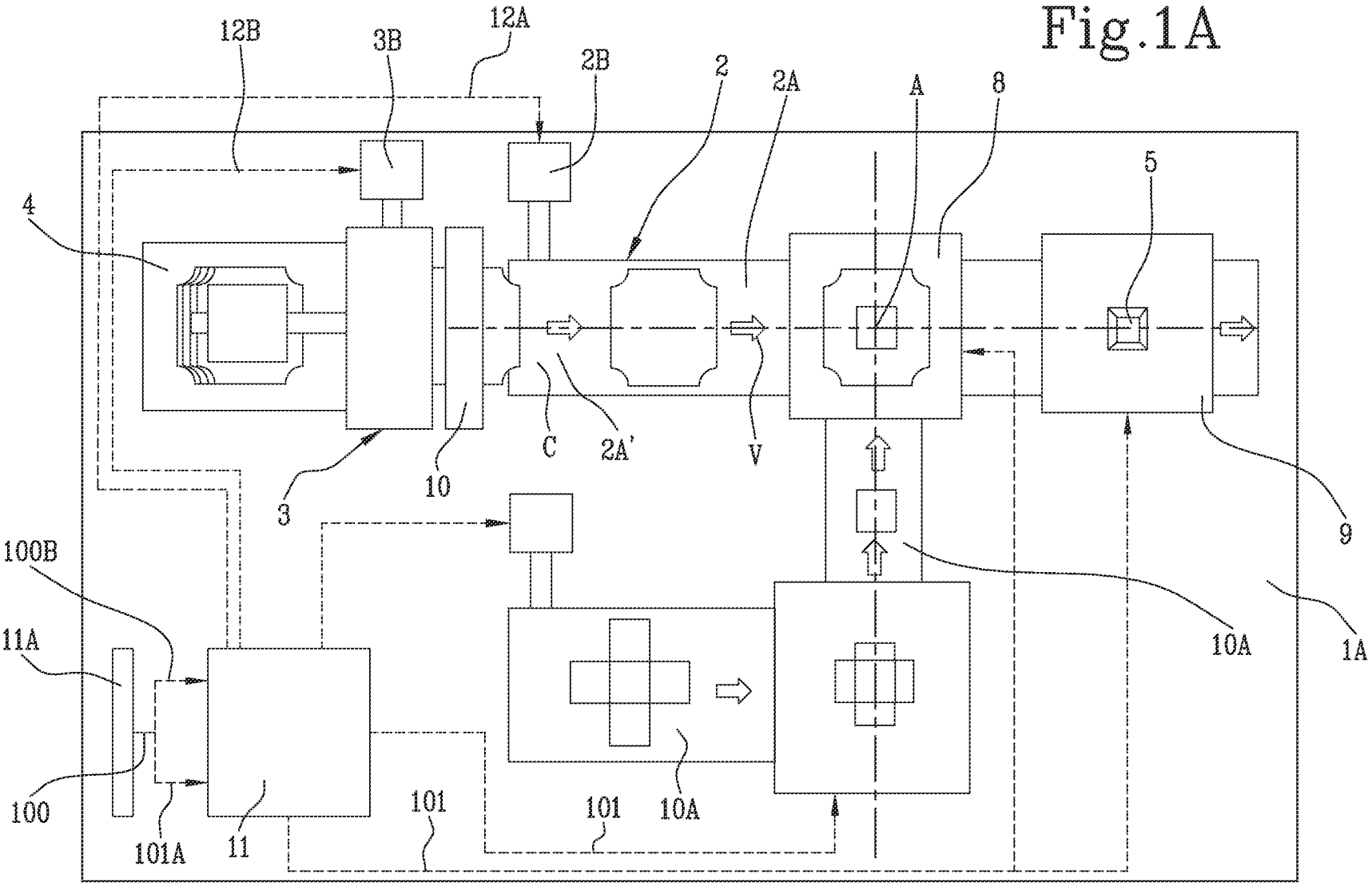
FIG. 1A schematically represents a plan view of the line of FIG. 1.
Figure 2:
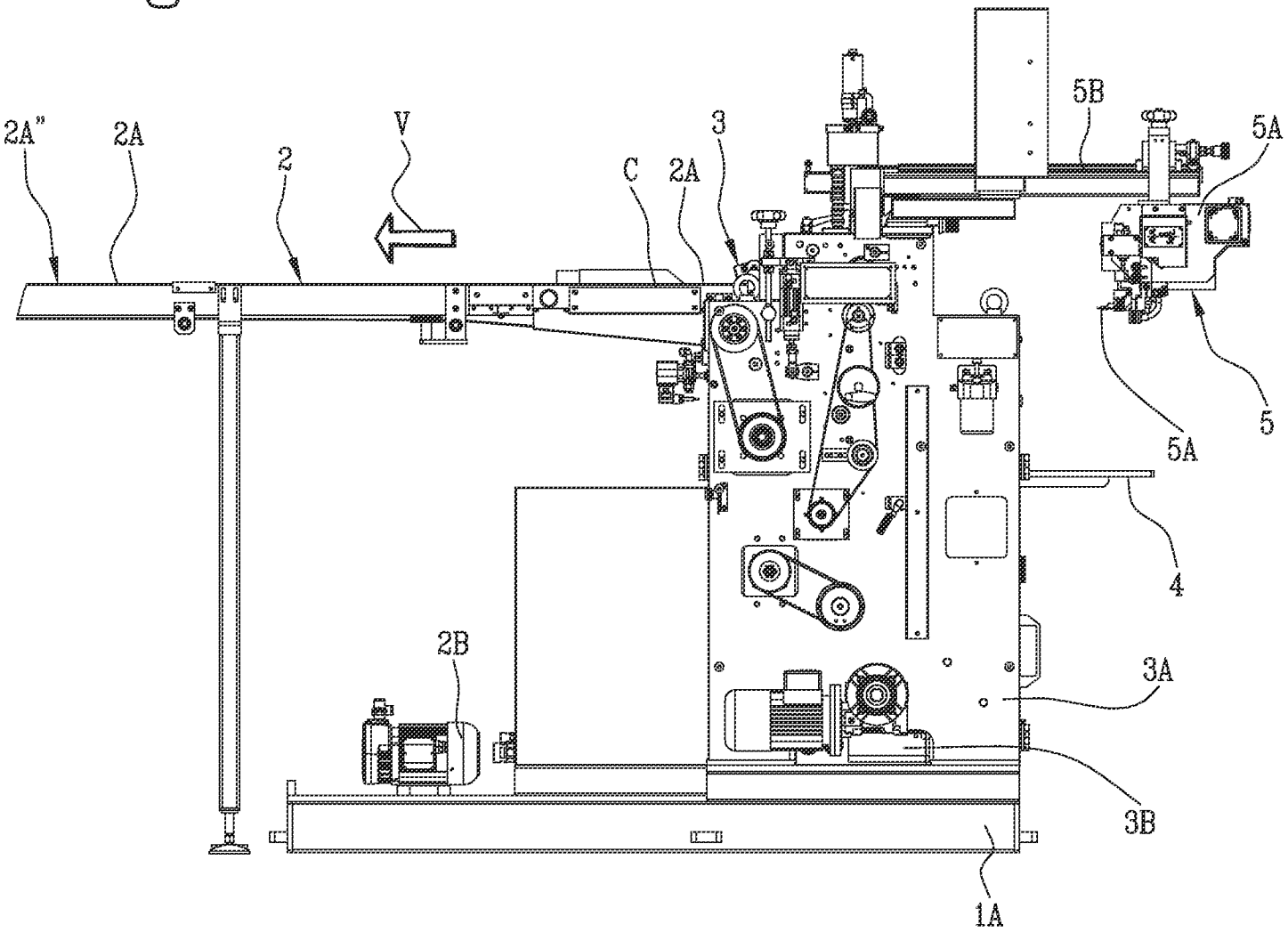
FIG. 2 is a side view of a feed unit of the line of FIG. 1.
Figure 2A:
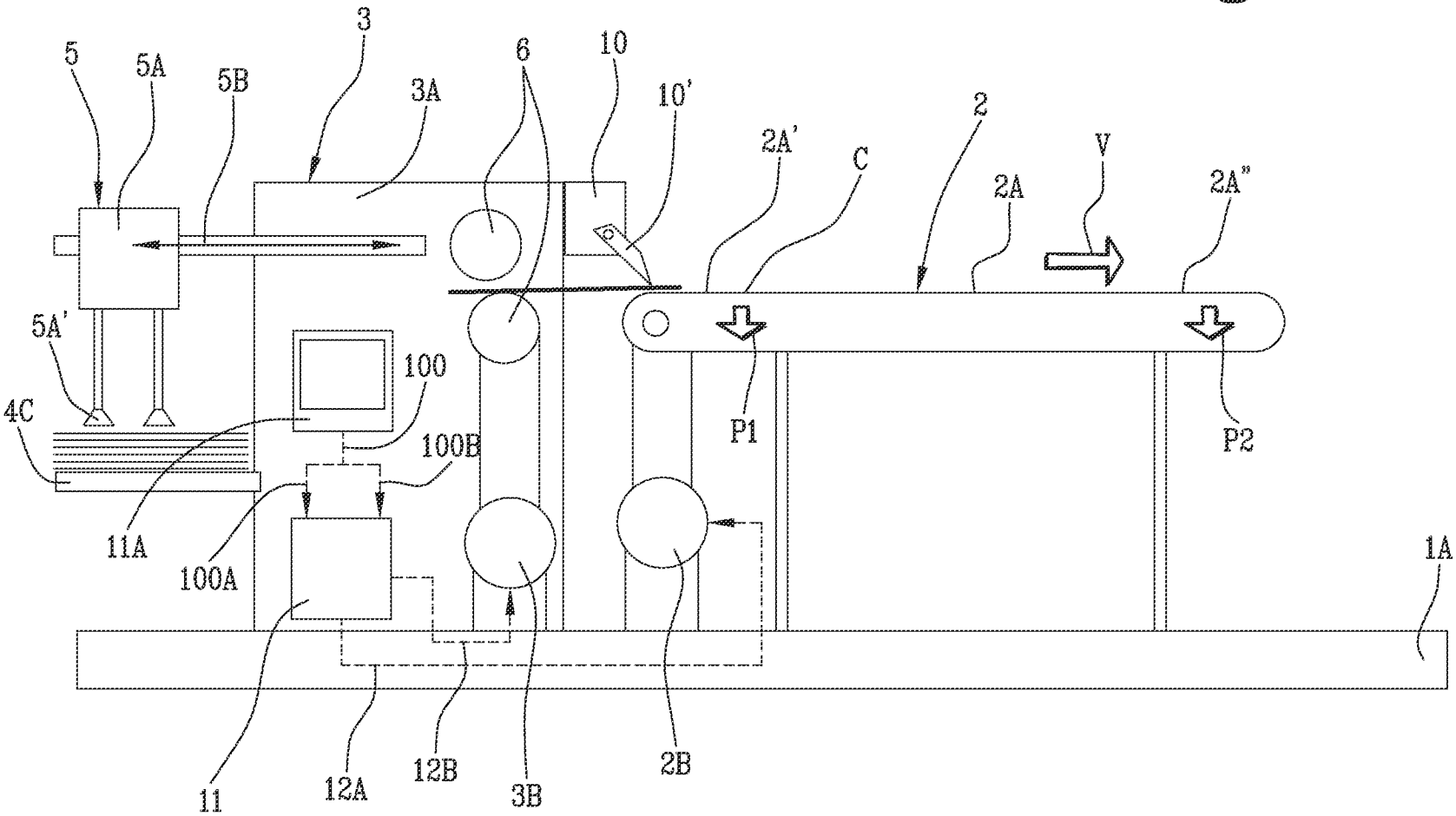
FIGS. 2A and 2B schematically illustrate two embodiments of the feed unit of FIG. 2.
Figure 2B:
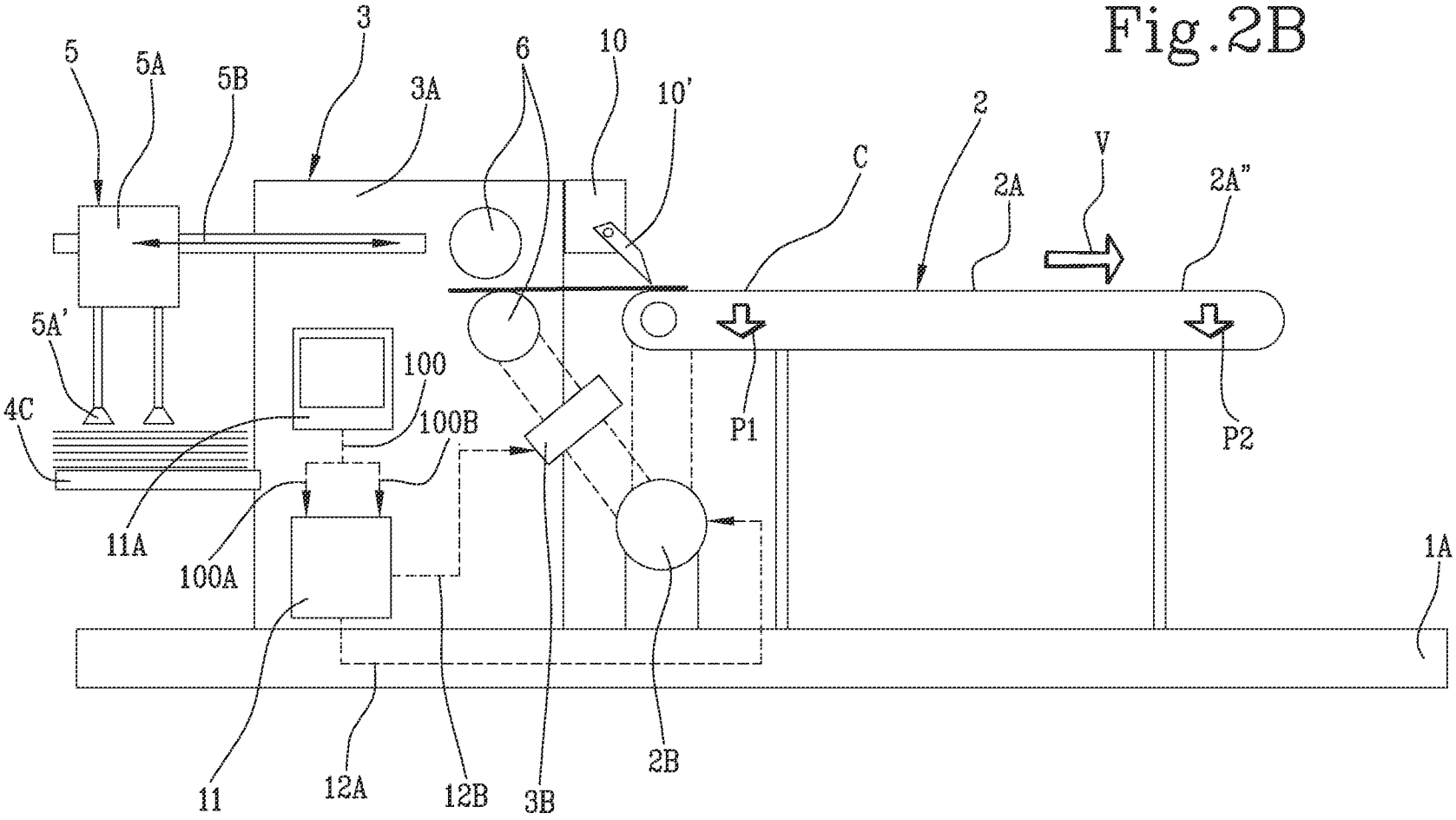
Figure 3:
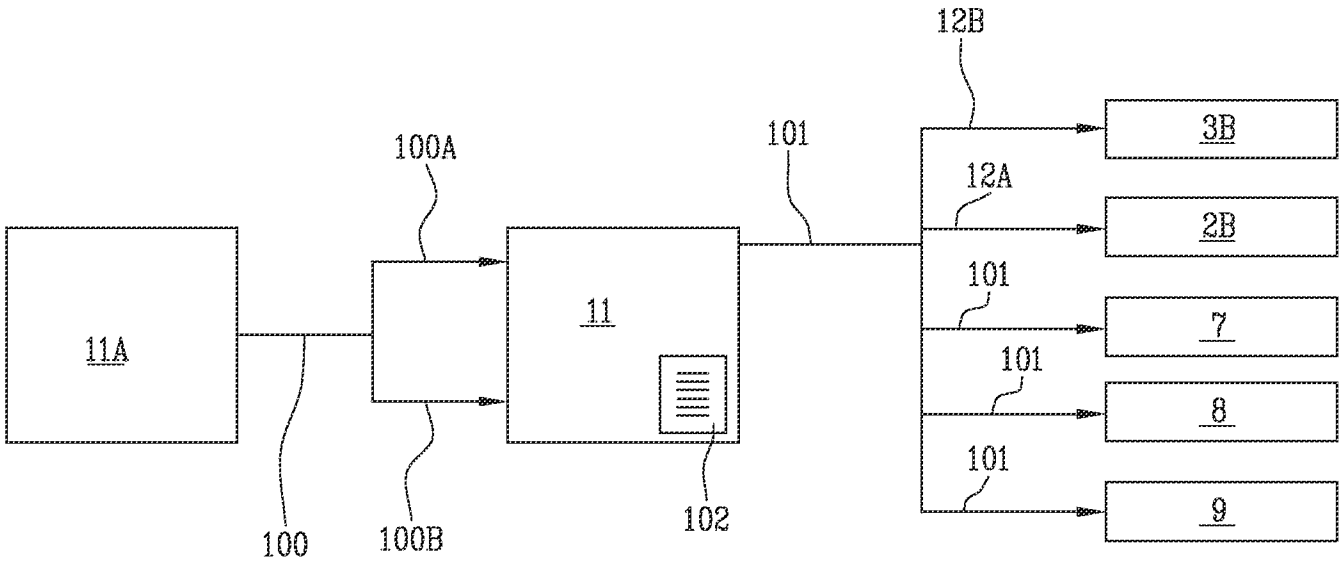
FIG. 3 schematically illustrates the connections of a control unit of the line of FIG. 1.
Figure 4:
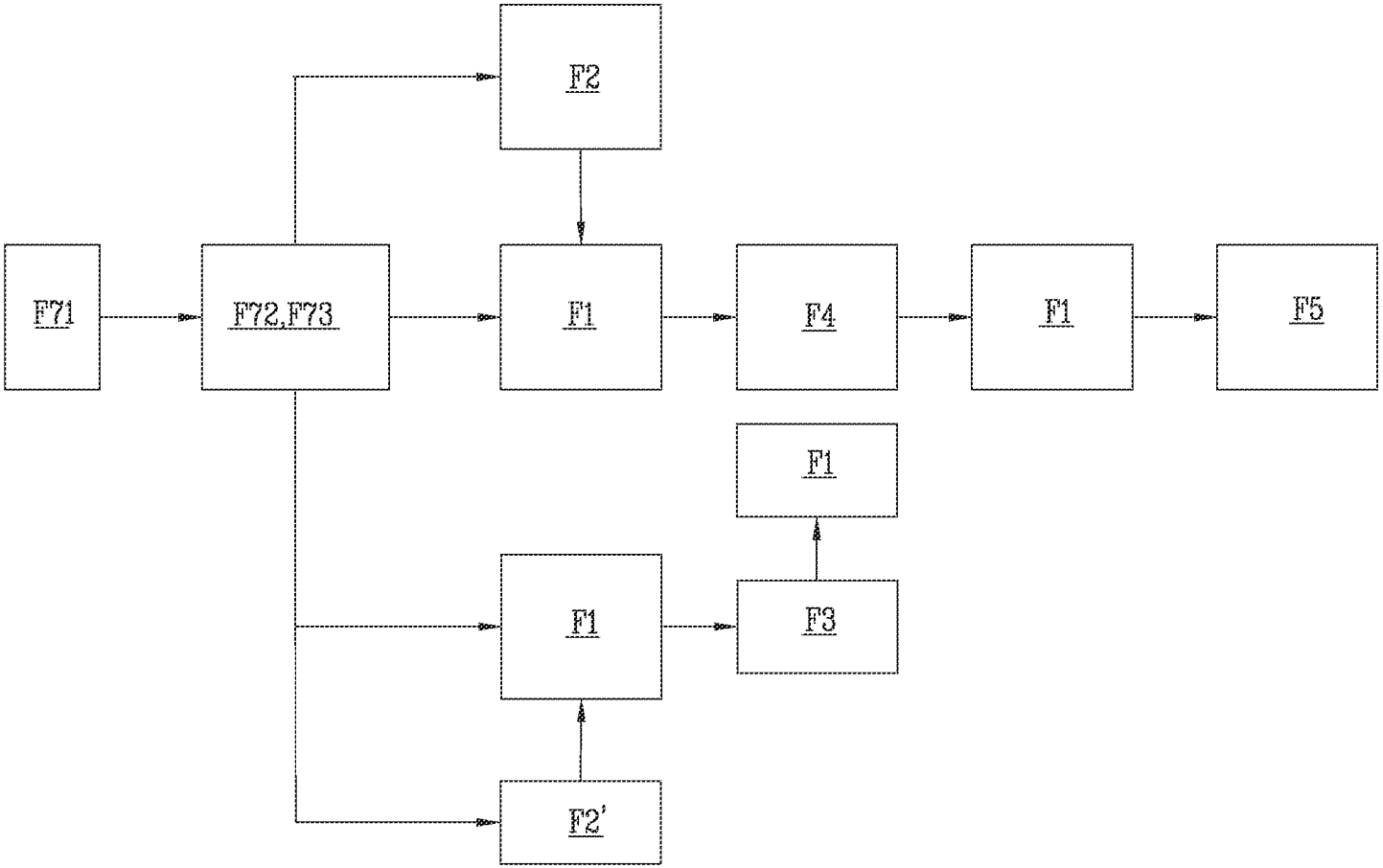
FIG. 4 schematically illustrates the steps of a method for the production of covered cardboard boxes.
Figure 5:
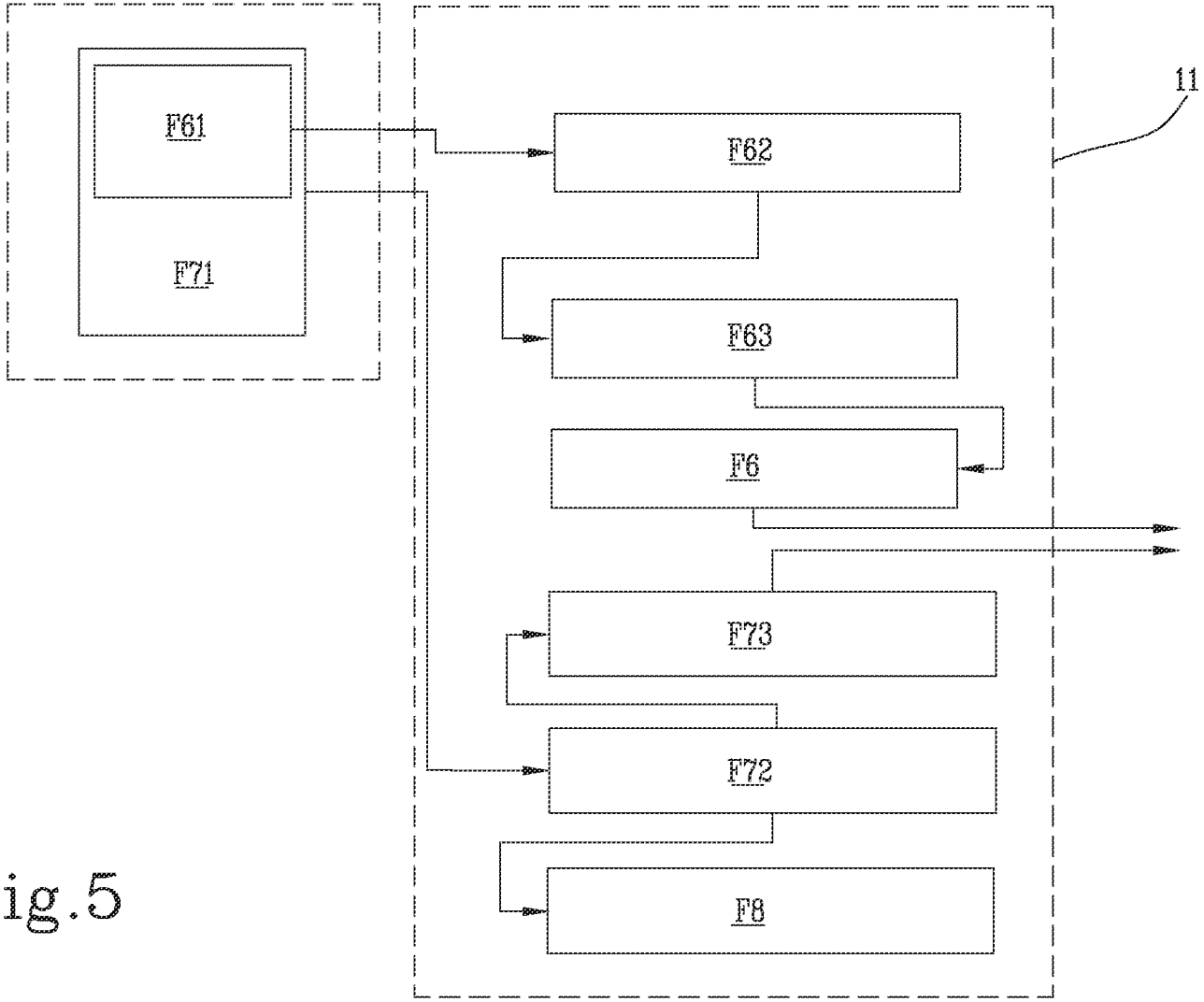
FIG. 5 schematically illustrates some of the steps of the method of FIG. 4.

With reference to the drawings listed above, the numeral 1 denotes a line 1 for the production of covered cardboard boxes.

The line 1 for the production of covered boxes is a line made up of several stations in which semi-finished products are processed to obtain covered boxes. More specifically, the line 1 is configured o process a plurality of covering blanks and a plurality of box blanks in order to obtain respective covered cardboard boxes.

In one embodiment, the line 1 comprises a base 1A.

In one embodiment, the line 1 comprises a conveyor unit 2.

In one embodiment, the conveyor unit 2 is connected to the base 1A.

In one embodiment, the conveyor unit 2 is configured to convey the covering blanks along a movement path.

In one embodiment, the conveyor unit 2 comprises a belt 2A.

In one embodiment, the conveyor unit 2 comprises a conveyor actuator 2B.

In one embodiment, the belt 2A of the conveyor unit 2 is movable to transport a plurality of covering blanks from a loading position C to an unloading position S.

The movement path is characterized by a movement orientation and a direction of movement V. More specifically the direction of movement V is oriented from the loading position C to the unloading position S.

In one embodiment, the conveyor actuator 2B is connected to the belt 2A.

In one embodiment, the conveyor actuator 2B is configured to drive the belt 2A. In one embodiment, the conveyor actuator 2B is configured to drive the belt 2A intermittently, in an alternating sequence of movements and stops. In one embodiment, the line 1 comprises a conveyor section 10A. In one embodiment, the conveyor section 10A is configured to transport the box blanks to a coupling position A on the belt 2A, interposed between the loading position C and the unloading position S. in one embodiment, the line 1 comprises an insertion actuator 10B. In one embodiment, the insertion actuator 10B is configured to drive the conveyor section 10A. In one embodiment, the feed actuator 10B coincides with the conveyor actuator 2B. In this embodiment, the drive motion provided by the conveyor actuator 2B is transmitted to the conveyor section 10A through suitable drive transmission means.

In one embodiment, the line 1 comprises a feed unit 3.

In one embodiment, the feed unit 3 is connected to the base 1A. In one embodiment, the feed unit 3 comprises a load-bearing structure 3A.

In one embodiment, the load-bearing structure 3A of the feed unit 3 is integral with the base 1A.

The feed unit 3 is configured to pick up the covering blanks from a reservoir. In one embodiment, the reservoir is a shelf 4 which is connected to the feed unit 3 and on which the plurality of covering blanks is stacked.

In one embodiment, the shelf 4 is configured to move translationally along a stacking direction, along which the covering blanks are stacked. This allows the shelf 4 to adapt to the number of covering blanks present on the shelf 4 itself, which moves progressively closer to the feed unit 3 until all the covering blanks are finished.

In one embodiment, the feed unit 3 is configured to feed the covering blanks individually to the conveyor unit 2. In one embodiment, the feed unit 3 is configured to feed the covering blanks individually to the conveyor unit 2 at the loading position C, in a sequence of feed instants.

In one embodiment, the conveyor unit 2 comprises a pickup device 5. In one embodiment, the pickup device 5 is configured to pick up the covering blanks from the shelf 4. In one embodiment, the pickup device 5 comprises a suction cup 5A'. In one embodiment, the pickup device may comprise more than one suction cup 5A'. The suction cup 5A' is configured to pick up a single covering blank from the plurality of covering blanks disposed on the shelf 4.

In one embodiment, the pickup device 5 comprises a translating head 5A. In one embodiment, the pickup device 5 comprises a slide 5B.

In one embodiment, the translating head 5A is configured to move translationally along the slide 5B to pick up the covering blanks in a zone which is distal from the loading position C and to move a single covering blank close to a zone which is proximal to the loading position C.

In one embodiment, the feed unit 3 comprises a plurality of feed rollers 6. In one embodiment, the plurality of feed rollers 6 is configured to receive a single covering blank picked up from the shelf 4 and to feed it to the loading position C of the belt 2A.

In one embodiment, at least two rollers of the plurality of feed rollers 6 rotate in opposite directions in such a way as to bring the covering blank up to the loading position C on the belt 2A.

In one embodiment, the translating head 5A is configured to release the covering blank at the plurality of feed rollers 6.

The plurality of feed rollers 6 is configured to retain the covering blank until reaching the feed instant of the plurality of feed instants.

In one embodiment, the feed unit 3 comprises a feed actuator 3B. In one embodiment, the feed unit 3B is connected to the translating head 5A. In one embodiment, the feed actuator 3B is connected to the plurality of feed rollers 6.

In one embodiment, the feed actuator 3B is connected to the feed unit 3 to pick up the covering blanks from a reservoir.

In one embodiment, the feed actuator 3B is connected to the translating head 5A of the pickup device 5 to pick up the covering blanks from the shelf 4.

In one embodiment, the feed actuator 3B is connected to the feed unit 3 to feed one covering blank at a time to the loading position C on the belt 2A.

In one embodiment, the feed actuator 3B is connected to the plurality of feed rollers 6 to feed one covering blank at a time to the loading position C on the belt 2A.

In one embodiment, the feed actuator 3B coincides with the conveyor actuator 2B. In this embodiment, the conveyor actuator 2B and the feed unit 3 are connected. In one embodiment, there is a variation unit 3B' interposed between the conveyor actuator 2B and the feed unit 3.

The variation unit 3B' is configured to vary the drive motion from the conveyor actuator 2B and to transmit it to the feed unit 3.

In one embodiment, the variation unit 3B' is configured to vary a feed instant relative to an activation instant of the conveyor actuator 2B. In this embodiment, the variation unit 3B' is configured to transmit torque or drive power to the feed unit 3 with a phase displacement relative to the instant at which the torque or drive power is supplied to the conveyor actuator 2B.

In one embodiment, the variation unit 3B' is configured to vary the intensity of the drive power.

In one embodiment, the variation unit 3B' comprises a friction clutch. The friction clutch comprises a first part which is integral with the conveyor actuator 2B and a second part which is integral with the feed unit 3. The friction clutch is configured to guarantee a phase displacement s between the instant at which the first part of the friction clutch starts moving and the instant at which the second part of the friction clutch engages the first part of the friction clutch.

This embodiment is mentioned purely by way of example. An expert in the trade would be capable of designing different types of variations units configured to phase-displace the transmission instant relative to the activation instant of the conveyor actuator 2B. By way of non-limiting example, systems comprising cam profiles might also be used.

In one embodiment, the line 1 comprises an erecting machine 7. The erecting machine 7 is configured to receive the cardboard box blanks and to fold them to form corresponding boxes. The erecting machine 7 is connected to the base 1A of the line 1.

In one embodiment, the erecting machine 7 is located along the conveyor section 10A. In one embodiment, the conveyor section 10A is configured to transport box blanks to the erecting machine 7. In one embodiment, the conveyor section 10A is configured to pick up the box blanks which have been folded in the erecting machine 7 and to transport them to the coupling position A on the belt 2A of the conveyor unit 2.

In one embodiment, the line 1 comprises a positioner 8.

In one embodiment, the positioner 8 is configured to receive the boxes from the erecting machine 7. In one embodiment, the positioner 8 is configured to position the boxes individually in alignment on corresponding covering blanks disposed on the belt 2A of the conveyor unit 2, at a coupling position A interposed between the loading position C and the unloading position S.

In one embodiment, the positioner 8 is rigidly connected to the base 1A of the line 1. The rigid connection reduces the vibrations of the positioner 8 and thus allows greater positioning precision.

In one embodiment, the positioner 8 is configured to receive the covering blanks by from the belt 2A of the conveyor unit 2. In one embodiment, the positioner 8 is configured to receive the boxes from the conveyor section 10A after they have been folded in the erecting machine 7.

In one embodiment, the line 1 comprises a gluer 10. In one embodiment, the gluer 10 is configured to spread glue on one face of the covering blanks which will come into contact with a corresponding surface of the boxes to be covered.

In one embodiment, the gluer 10 is connected to the feed unit 3. In one embodiment, the gluer 10 is located between the loading position C on the belt 2A and the feed unit 3.

In one embodiment, the gluer 10 comprises an idle arm 10'. In one embodiment, the glue to be spread on the face of the covering blanks which will come into contact with a corresponding surface of the boxes to be covered is present on a free end of the idle arm 10'. In one embodiment, the idle arm 10' is movable idly in such a way as to remain in contact with the face of the covering blank without damaging it. In one embodiment, the idle arm 10' comprises a spring configured to keep the idle arm 10' in contact with the face of the covering blank.

In one embodiment, the line 1 comprises a covering machine 9. In one embodiment, the covering machine 9 is configured to receive the boxes coupled to the respective covering blanks from the conveyor unit 2 at the unloading position S. In one embodiment, the covering machine 9 is configured to fold the covering blank into contact with the respective box in such a way as to cover it.

In one embodiment, the covering machine 9 is rigidly connected to the base 1A of the line 1. The rigid connection reduces the vibrations of the covering machine 9 and thus allows greater covering precision.

In one embodiment, the line 1 comprises a control unit 11.

In one embodiment, the line 1 comprises a user interface. The user interface is connected to the control unit 11.

In one embodiment, the user interface is local. In this embodiment, the user interface may be a display 11A which is physically connected to the machine.

In one embodiment, the user interface is remote. In this embodiment, the user interface may be a smartphone, a tablet or a portable computer or any device capable of being remotely connected to the control unit 11.

In one embodiment, the control unit 11 is connected to the feed unit 3. In one embodiment, the control unit 11 is connected to the feed unit 3 to adjustably set a phase displacement s of the feed instants relative to the sequence of stops of the belt 2A.

In one embodiment, the control unit 11 is connected to the conveyor unit 2. In one embodiment, the control unit 11 is connected to the positioner 8. In one embodiment, the control unit 11 is connected to the covering machine 9. In one embodiment, the control unit 11 is connected to the erecting machine 7. In one embodiment, where the line 1 comprises the feed actuator 3B, the control unit 11 is connected to the feed actuator 3B.

In one embodiment, where the machine comprises the variation unit 3B', the control unit 11 is connected to the variation unit 3B'.

In one embodiment, the control unit 11 is programmed to activate the feed actuator 3B and the conveyor actuator 2B in a synchronous and phase-displaced manner according to the phase displacement s of the feed instants relative to the corresponding stops of the belt 2A.

In this embodiment, the control unit 11 is configured to send a convey signal 12A and a feed signal 12B.

The convey signal 12A is sent to the conveyor actuator 2B. The feed signal 12B is sent to the feed actuator 3B. The control unit 11 is programmed to send the convey signal 12A and the feed signal 12B in a synchronous and phase-displaced manner according to the phase displacement s of the feed instants relative to the corresponding stops of the belt 2A. The convey signal 12A and the feed signal 12B are received by the conveyor actuator 2B and by the feed actuator 3B, respectively, which in turn drive the conveyor unit 2 and the feed unit 3, respectively.

In one embodiment, the control unit 11 is programmed to activate the feed actuator 3B in the sequence of feed instants, which are temporally located in respective time intervals in which the belt 2A is in motion.

In one embodiment, the control unit 11 is programmed to send the feed signal 12B in the sequence of feed instants, which are temporally located in respective time intervals in which the convey signal 12A has already been received by the conveyor actuator 2B.

In one embodiment, the control unit 11 is connected to the conveyor actuator 2B to vary the sequence of movements and stops of the belt 2A.

In one embodiment, the control unit 11 is configured to receive order data 100. In one embodiment, the order data 100 include format data 100A representing a format of the covering blanks.

In one embodiment, the order data 100 include productivity data 100B representing the quantity to be produced for a given format.

In one embodiment, the order data 100 refer to a plurality of orders to be processed in the machine. More specifically, in this embodiment, the order data 100 include an order sequence. In one embodiment, the order sequence comprises, for each order in the sequence, the format data 100A and the productivity data 100B.

In one embodiment, the control unit 11 is configured to process the order data 100. In one embodiment, the control unit 11 is configured to process the format data 100A and to set the sequence of movements and stops of the belt 2A.

In one embodiment, the control unit 11 is configured to process the format data 100A and to set working data 101 representing the sequence of movements and stops of the belt 2A as a function of the format data 100A.

In one embodiment, the control unit 11 is configured to process the order data 100 and to set the working data 101.

In one embodiment, the working data 101 include the phase displacement s of the feed instants relative to the sequence of stops of the belt 2A.

In one embodiment, the working data 101 include one or more of the following parameters:

a working spacing p, defined by a distance between two consecutive covering blanks disposed on the belt 2A, measured in a direction of maximum extension of the belt 2A;

a speed of the belt 2A;

a duration of the stops of the belt 2A;

a stop/move repetition period T;

a number of pieces to be produced for each format;

tool force, speed and trajectory of the erecting machine 7, covering machine 9 and positioner 8;

a speed of the conveyor section 10A.

In one embodiment, the control unit 11 is configured to process an order time schedule 102 as a function of the productivity data 1006.

The order time schedule 102 allows the control unit 11 to perform a changeover automatically and without significant stops. The order time schedule 102 allows the control unit 11 to adapt the working data 101 automatically and without significant stops.

More specifically, the control unit 11 is configured to vary the sequence of movements and stops of the belt 2A as a function of the order time schedule 102.

In one embodiment, the belt 2A of the conveyor unit 2 comprises a suction unit. The suction unit is configured to apply a suction force perpendicularly to a plane containing the belt 2A and directed from the belt 2A to a supporting surface on which the base 1A of the line 1 is rested or fixed.

In one embodiment, the belt 2A comprises a first suction zone 2A'. The first suction zone 2A' is adjacent to the feed unit 3. The first suction zone 2A' is configured to apply a first suction force P1.

In one embodiment, the belt 2A comprises a second suction zone 2A". In one embodiment, the second suction zone 2A" is spaced from the feed unit 3. The second suction zone 2A" is configured to apply a second suction force P2.

In one embodiment, the second suction force P2 is smaller than the first suction force P1. This allows the belt 2A to keep the covering blank more adherent to the belt 2A during the feed step F2, where the probability of its coming away is higher because feeding occurs with the belt 2A already in motion.

According to one aspect of this disclosure, this invention provides a method for making covered cardboard boxes.

In one embodiment, the method comprises a step F1 of intermittently conveying a plurality of covering blanks from a loading position C to an unloading position S.

In one embodiment, the step F1 of intermittently conveying is performed by means of a conveyor unit 2 including a belt 2A which is driven intermittently by a conveyor actuator 2B in an alternating sequence of movements and stops.

Hereinafter, Ts is used to denote a stop time, that is, the length of time in which the belt 2A is not driven, Ta a movement time, that is, the length of time in which the belt 2A is driven and T the period, that is the time from one starting of the belt 2A to the next starting, equal to the sum of the stop time Ts plus the movement time Ta. The speed of the belt 2A when in motion is denoted by the letter v.

During the step of conveying, the conveyor actuator 2B drives the belt 2A. The belt 2A carries the covering blanks on its surface and transports them along a movement path in a direction of movement V, oriented from the loading position C to the unloading position S.

In one embodiment, the belt 2A moves intermittently.

In another embodiment, the belt 2A can move continuously. In one embodiment, the belt 2A, when in motion, moves at a constant speed v. In another embodiment, the belt 2A, when in motion, moves at variable speed. In this embodiment, the variable speed might fulfil the need for a buffer station.

In one embodiment, the step F1 of conveying is a step of conveying the covering blank coupled to the previously erected box up to the unloading position S.

In one embodiment, the step F1 of conveying is a step of conveying a plurality of box blanks along a conveyor section 10A, outside of and merging into the belt 2A in a coupling position A, interposed between the loading position C and the unloading position S on the belt 2A.

In one embodiment, the step F1 of conveying is a step of conveying a formed box, obtained by folding a box blank of the plurality of box blanks, along the conveyor section 10A up to the coupling position A on the belt 2A.

In one embodiment, the method comprises a step of picking up covering blanks individually from a reservoir by means of a feed unit 3. In one embodiment, the method comprises a step F2 of feeding the covering blanks to the loading position C of the belt 2A by means of the feed unit 3, in a sequence of feed instants.

In one embodiment, the step F2 of feeding the covering blanks to the loading position C of the belt 2A is performed with the belt 2A of the conveyor unit 2 in motion.

In one embodiment, in which the feed unit 3 comprises a feed actuator 3B which is separate from the conveyor actuator 2B, the feed actuator 3B drives the feed unit 3 to feed the covering blanks.

Hereinafter, the term "feed instant la" will be used to denote an instant at which the feed unit 3 starts feeding the covering blank to the conveyor unit 2, the term "starting instant $t_0$", an instant at which the conveyor actuator 2B starts driving the belt 2A and the term "stop instant ts", an instant at which the conveyor actuator 2B stops driving the belt 2A. Hereinafter, the term "spacing p" will be used to denote the distance along the belt 2A between two consecutive covering blanks located on the belt 2A. The reference Tf in the drawings denotes a feed time, meaning by this the time that elapses between the feed instant and an instant at which the covering blank is effectively placed in the loading position C of the belt 2A.

In one embodiment, during the step of picking up, a pickup device 5 picks up a single covering blank from a shelf 4 on which the plurality of covering blanks is stacked.

In one embodiment, in which the pickup device 5 comprises a translating head 5A and a slide 5B, the translating head 5A engages the single covering blank to be fed. In one embodiment, the translating head 5A moves translationally along the slide 5B to carry the single covering blank from a position which is distal from the loading position C on the belt 2A to a position which is proximal to the loading position C on the belt 2A.

In one embodiment, in which the translating head 5A comprises a suction cup 5A', the latter engages the single covering blank to be fed.

In one embodiment, in which the feed unit 3 comprises a plurality of feed rollers 6, the pickup device 5 releases the single covering blank in proximity to the feed rollers so that the latter can receive it.

In one embodiment, at least two rollers of the plurality of feed rollers 6 rotate in opposite directions. In one embodiment, during the step F2 of feeding, the single covering blank to be fed is disposed between the at least two feed rollers rotating in opposite directions.

In one embodiment, the plurality of feed rollers 6 rotate and in doing so carry the single covering blank along with them in such a way as to feed it to the loading position C of the belt 2A.

In one embodiment, in which the feed actuator 3B is separate from the conveyor actuator 2B, the feed actuator 3B drives the plurality of feed rollers 6 in order to feed the covering blanks.

In one embodiment, in which the feed actuator 3B is separate from the conveyor actuator 2B, the feed actuator 3B drives the pickup device 5 to pick up the covering blanks.

In one embodiment, the method comprises a secondary step F2' of feeding, in which a box blank of the plurality of box blanks is picked up individually from secondary reservoir and fed individually to a conveyor section 10A.

In one embodiment, the method comprises a step of receiving box blanks in an erecting machine 7. In one embodiment, the method comprises a step F3 of folding the box blanks to form corresponding boxes.

In one embodiment, the method comprises a step F4 of positioning each box in alignment on a corresponding covering blank disposed on the belt 2A. In one embodiment, the step F4 of positioning is carried out at a coupling position A, interposed between the loading position C and the unloading position S.

In one embodiment, the method comprises a step of spreading glue on one face of the covering blanks which will come into contact with a corresponding surface of the boxes to be covered, which will hereinafter be referred to as inside face of the covering blank.

In one embodiment, during the step of spreading glue, the single covering blank to be fed is made to pass through a gluer 10 before reaching the loading position C on the belt 2A. In one embodiment, the gluer 10 spreads glue on the inside face of the covering blank while the latter is in motion.

In one embodiment, in which the gluer 10 comprises an idle arm 10', a free end of the idle arm 10' where the glue is, remains in contact with the inside face of the covering blank as the latter moves towards the loading position C of the belt 2A.

In one embodiment, the method comprises a step of feeding the boxes coupled to the respective covering blanks to a covering machine 9.

In one embodiment, the covering machine 9 folds the covering blank into contact with the respective box in such a way as to cover the box.

In one embodiment, the method comprises a step F5 of covering a box with its respective covering blank.

In one embodiment, the method comprises a step F6 of adjustably setting a phase displacement s of the feed instants relative to the sequence of stops of the belt 2A. This step F6 of adjustably setting is performed by a control unit 11.

In one embodiment, the method comprises a step F61 of entering format data. During this step, a machine operator using a local or remote interface can enter format data representing a format of the covering blanks.

In one embodiment, the method comprises a step F62 of receiving format data. During this step, the control unit 11 receives the format data 100A from the user interface for processing.

In one embodiment, the method comprises a step F63 of processing format data.

During the step F63 of processing format data, the control unit 11 processes the format data 100A to determine working data 101 which include the phase displacement s of the feed instants relative to the sequence of stops of the belt 2A.

During the step F63 of processing format data, the control unit 11 takes the following quantities into account:

Distance of the feed unit from the positioner 8, hereinafter denoted D1

Distance of the positioner 8 from the covering machine 9, hereinafter denoted D2

Speed v of the belt 2A

Spacing p limit ($p_{lim}$), being the minimum distance along the belt 2A between two consecutive covering blanks disposed on the belt 2A, determined as a function of the size of the covering blank.

In one embodiment, the step F63 of processing format data comprises a first step of determining the spacing p. The spacing p is a function of the distance D2 and of the limit spacing $p_{lim}$.

More specifically, in one embodiment, the spacing p can be determined with the following formula:

$$p = D2/\left\lfloor \frac{D2}{p_{lim}} \right\rfloor$$

Where the spacing p is determined by the distance D2 divided by the whole number part of the result of division of D2 and the spacing $p_{lim}$.

In one embodiment, the spacing p thus determined is the minimum spacing p obtainable as a function of the limit spacing although there might be other constraints which are not mentioned in this specification.

It is understood that it is not an aim of this specification to describe how the spacing p is determined and the above is set out purely by way of non-limiting example.

In one embodiment, the step F63 of processing format data comprises a step of determining a phase displacement distance f.

More specifically, in one embodiment, the phase displacement distance f can be determined with the following formula:

$$f = \left(\frac{D1}{p} / \left\lfloor \frac{D1}{p} \right\rfloor\right) * p$$

Knowing the speed of the belt 2A automatically allows determining the phase displacement s of the feed instants relative to the sequence of stops of the belt 2A.

$$s = \frac{f}{v}$$

In this case, too, it is stressed that the analytical relations set out above are not intended to exhaustively describe the mathematical methods used to determine the phase displacement distance f and the phase displacement s of the feed instants relative to the stops of the belt 2A. What is set out above therefore is of non-limiting, exemplary nature and relates to one of the possible embodiments of the step of processing format data 100A.

In one embodiment, the step F6 of adjustably setting comprises sending a phase displacement signal to the conveyor unit 2 and to the feed unit 3.

In one embodiment, during the step of adjustably setting F6 the control unit 11 sends a convey signal 12A to the conveyor unit 2.

In one embodiment, during the step F6 of adjustably setting the control unit 11 sends a feed signal 12B to the feed unit 3.

In one embodiment, during the step F6 of adjustably setting the control unit 11 sends a convey signal 12A to the conveyor actuator 2B.

In one embodiment, in which the feed unit 3 comprises a feed actuator 3B which is separate from the conveyor actuator 2B, during the step F6 of adjustably setting the control unit 11 sends a feed signal 12B to the feed actuator 3B.

More specifically, the control unit 11 may advance or delay the feed instant as a function of the value of the phase displacement s. Delayed feeding is when the control unit 11 delays the feed instant and, vice versa, advanced feeding is when the control unit 11 advances the feed instant.

The advanced feed and delayed feed configurations are described below.

Figure 6A:
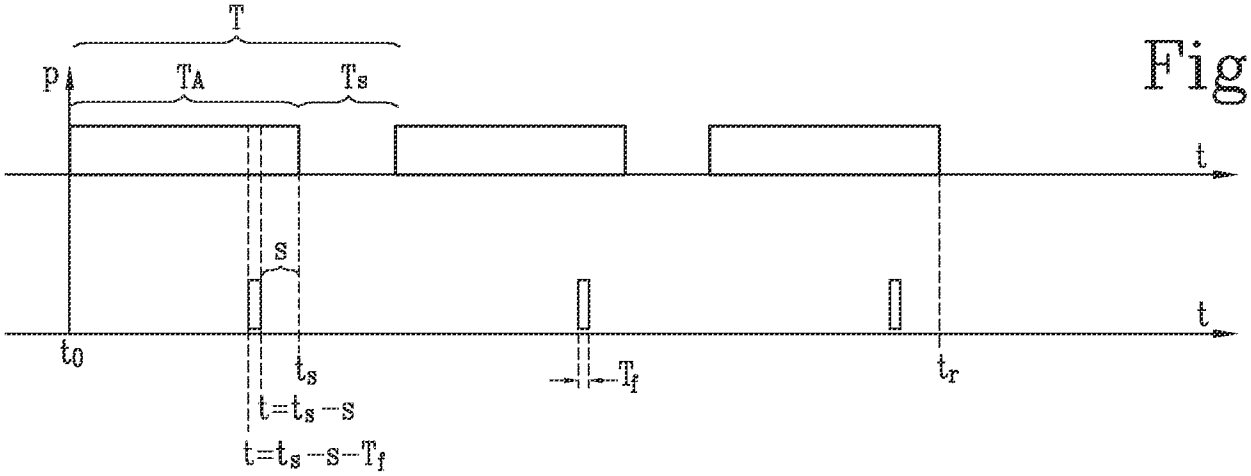
FIG. 6A schematically illustrates a time graph of the operation of the conveyor and feed units of the line of FIG. 1, in an embodiment in which the feed unit is phase-advanced relative to the conveyor unit.
Figure 6E:
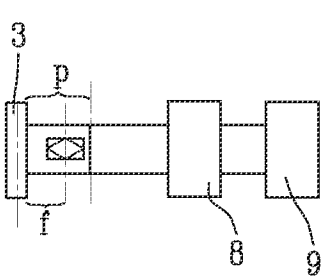
FIG. 6E schematically illustrates the line of FIG. 1 at the instant of time, labelled "ts" in FIG. 6A.
Figure 6D:
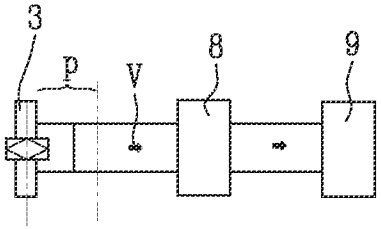
FIG. 6D schematically illustrates the line of FIG. 1 at the instant of time, labelled "ts-s" in FIG. 6A.
Figure 6C:
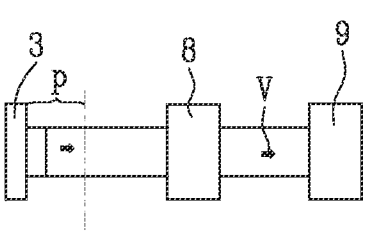
FIG. 6C schematically illustrates the line of FIG. 1 at the instant of time, labelled "ts-s-$T_f$" in FIG. 6A.
Figure 6B:
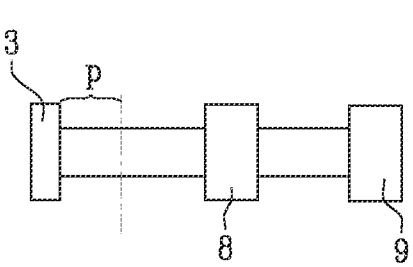
FIG. 6B schematically illustrates the line of FIG. 1 at the instant of time, labelled "$t_0$" in FIG. 6A, where "$t_0$" indicates a starting instant at which there are still no blanks on the belt.
Figure 6F:
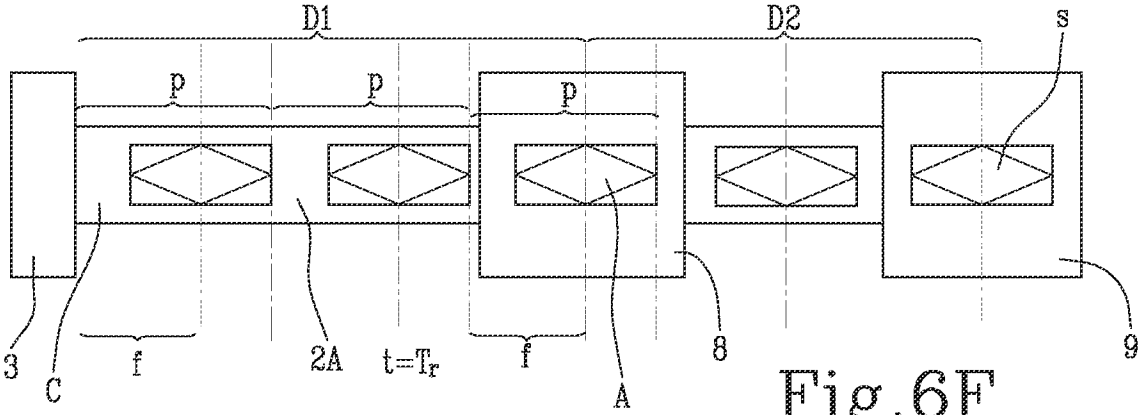
FIG. 6F schematically illustrates the line of FIG. 1 at the instant of time, labelled "$t_r$" in FIG. 6A, where "$t_r$" indicates an instant of time in which the line is working in steady state.
Figure 7A:
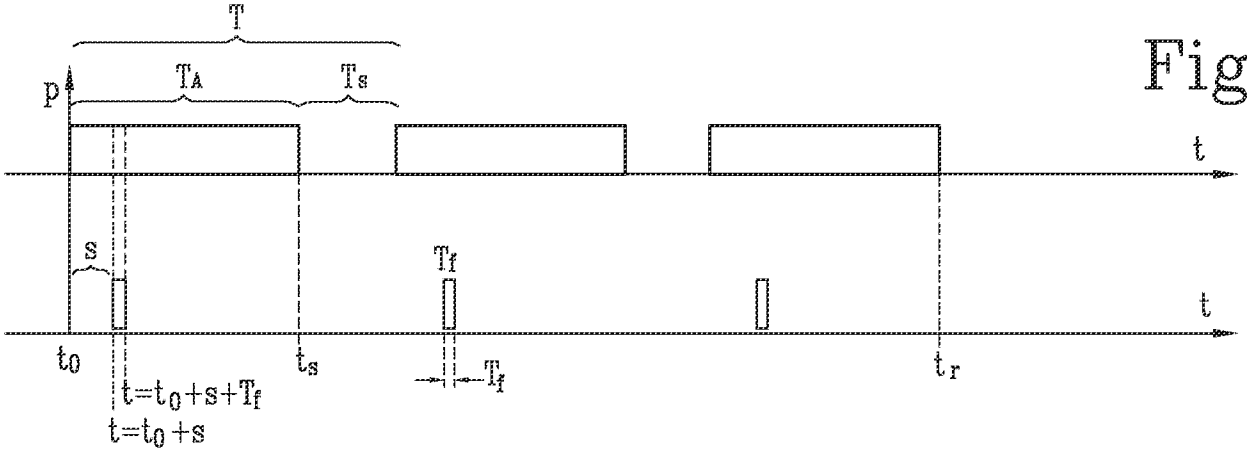
FIG. 7A schematically illustrates a time graph of the operation of the conveyor and feed units of the line of FIG. 1, in an embodiment in which the feed unit is phase-delayed relative to the conveyor unit.

Advanced feed and delayed feed are illustrated in FIGS. 6A and 6B, respectively. For a clearer understanding of these drawings, it should be noted that to denotes a start instant and is denotes a stop instant. The other symbols used in the drawings were explained previously.

The alternating sequence of movements and stops defines a sequence of start instants and a sequence of stop instants.

In one embodiment, in which feeding is advanced, the control unit 11 sends the convey signal 12A to the conveyor actuator 2B at a start instant to of the sequence of start instants. The convey signal 12A is maintained for the entire movement time Ta of the belt 2A.

In one embodiment, the control unit 11 sends the feed signal 12B at the feed instant, which is advanced by a quantity equal to the phase displacement s relative to a stop instant is of the belt 2A of the sequence of stop instants.

In this embodiment, when the belt 2A is started again, the covering blank is already on the belt 2A and, more specifically, is advanced by a distance equal to the phase displacement distance f. This allows the covering blank to be located at the coupling position A on the belt 2A, where it would not have arrived with the spacing p if feed were not advanced.

In one embodiment, in which feeding is delayed, the control unit 11 sends the convey signal 12A to the conveyor actuator 2B at a start instant to of the sequence of start instants. The convey signal 12A is maintained for the entire movement time Ta of the belt 2A.

In one embodiment, the control unit 11 sends the feed signal 12B at the feed instant, which is delayed by the phase displacements relative to the feed instant of the belt 2A.

In this embodiment, when the belt 2A is started again to convey the next blank, the preceding covering blank is behind by a distance equal to the phase displacement distance f. This allows the covering blank to be located at the coupling position A on the belt 2A, which it would otherwise pass by the spacing p if feed were not delayed.

In both cases, if feed were not delayed or advanced and if, instead, the spacing p were adjusted in such a way as to be exactly at the coupling position A, there would be misalignment at the covering machine 9. The only way to obtain correct placement both at the coupling position A on the positioner 8 and on the covering machine 9 is to vary the mutual distances between feed unit 3, positioner 8 and covering machine 9. The feed time delay, because it occurs with the belt 2A in motion, has the same technical effect as varying the distance between the feed unit 3 and the positioner 8 but has the big advantage of not requiring heavy weights to be moved.

In one embodiment, the control unit 11 activates the feed actuator 3B and the conveyor actuator 2B synchronously.

In one embodiment, the control unit 11 activates the feed actuator 3B and the conveyor actuator 2B in a phase-displaced manner as a function of the phase displacement s of the feed instants relative to the corresponding stops of the belt 2A.

In one embodiment, the control unit 11 activates the feed actuator 3B and the conveyor actuator 2B in a synchronous and phase-displaced manner as a function of the phase displacement s of the feed instants relative to the corresponding stops of the belt 2A.

In one embodiment, the control unit 11 sets the phase displacement s by sending the convey signal 12A and the feed signal 12B in a synchronous and phase-displaced manner to the conveyor actuator 2B and the feed actuator 3B, respectively.

In one embodiment, the control unit 11 sets the phase displacement s by sending the phase displacement signal to the feed unit 3.

In one embodiment, in which the feed unit 3 comprises a variation unit 3B', the control unit 11 sets the phase displacement s by sending to the variation unit 3B' the phase displacement signal as a function of which the variation unit 3B' delays or advances the drive motion from the conveyor actuator 2B.

In one embodiment, the method comprises a step F71 of entering order data. During the step F71 of entering order data, a machine operator enters the order data 100. In one embodiment, the order data 100 include the format data 100A. In one embodiment, the order data 100 include the format data 100A of two or more orders to be processed in sequence in the line 1. In one embodiment, the order data 100 include productivity data 100B. In one embodiment, the order data 100 include the productivity data 100B of two or more orders to be processed in sequence in the line 1.

In one embodiment, the order data 100 include a time sequence of the orders to be processed and tool specifications of the erecting machine 7, the positioner 8 or of the covering machine 9. In one embodiment, the order data 100 include all the information necessary for the line 1 to complete a working cycle on a batch and to complete the time sequence of two or more batches.

In one embodiment, the method comprises a step F72 of processing order data. During the step F72 of processing order data, the control unit 11 processes the order data 100 and sets working data 101.

In one embodiment, the control unit 11 varies the sequence of movements and stops of the belt 2A as a function of the order data 100.

In one embodiment, the control unit 11 varies the sequence of movements and stops of the belt 2A as a function of the format data 100A.

In one embodiment, the method comprises a step F73 of setting working data.

In one embodiment, during the step F73 of setting working data, the control unit 11 receives the format data 100A, representing a format of the covering blanks, and sets the sequence of movements and stops of the belt 2A as a function of the format data 100A.

In one embodiment, during the step of setting working data 101, the control unit 11 receives the order data 100 and sets the working data 101.

In one embodiment, the method comprises a step F8 of saving an order time schedule. During this step, the control unit 11, having processed the order data 100, creates an order time schedule 102, representing a time sequence of batches to be processed.

In one embodiment, the method comprises a step of automatic changeover. In one embodiment, during the step of automatic changeover, the control unit 11 is configured to automatically vary the alternating sequence of movements and stops as a function of the order time schedule 102.

In one embodiment, during the step of automatic changeover, the control unit 11 is configured to automatically vary the phase displacement s of the feed instants relative to the sequence of stops of the belt 2A, as a function of the order time schedule 102.

In one embodiment, during the step of automatic changeover, the control unit 11 is configured to automatically vary the working data 101, as a function of the order time schedule 102.

In one embodiment, the method comprises a step of applying suction.

In one embodiment, the step of applying suction comprises a first step of applying suction. During the first step of applying suction, a first suction zone 2A' of the belt 2A, adjacent to the feed unit 3, applies a first suction force P1 on the covering blanks. In one embodiment, the step of applying suction comprises a second step of applying suction. During the second step of applying suction, a second suction zone 2A" of the belt 2A, spaced from the feed unit 3, applies a second suction force P2 on the covering blanks.

In one embodiment, the second suction force P2 is smaller than the first suction force P1. This improves adherence to the belt 2A at the loading position C where dynamic feeding of the covering blanks might negatively affect the quality of the finished product.

What is claimed is:

1. A method of producing covered cardboard boxes, the method comprising:

transporting a plurality of covering blanks from a loading position to an unloading position, by means of a conveyor unit including a belt driven intermittently by a conveyor actuator in a sequence of movements, starting at respective movement instants and alternated with corresponding stops;

picking up the covering blanks and feeding them to the loading position of the belt by means of a feed unit, in a sequence of feed instants corresponding to the sequence of movements;

receiving box blanks in an erecting machine and folding the box blanks to form corresponding boxes;

positioning each box in alignment on a corresponding covering blank disposed on the belt, by a positioner at a coupling position interposed between the loading position and the unloading position;

spreading glue on one face of the covering blanks which will come into contact with a corresponding surface of the boxes to be covered;

transporting the boxes coupled to the respective covering blanks as far as the unloading position by means of the conveyor unit;

feeding the boxes coupled to the respective covering blanks to a covering machine which folds each covering blank into contact with a respective box in such a way as to cover the respective box;

adjustably setting, through a control unit, a phase displacement of the feed instants relative to corresponding movement instants of the belt;

with the control unit, receiving format data representing a format of the covering blanks; and by the control unit, setting working data as a function of the format data, the working data being representative of the sequence of movements of the belt, wherein the control unit adjusts the phase displacement of the feed instants relative to a sequence of stops of the belt responsive to the working data.

2. The method according to claim 1, wherein the control unit varies the sequence of movements and the stops of the belt.

3. The method according to claim 1, wherein a feed actuator is provided for driving the feed unit, the feed actuator being separate from the conveyor actuator, and wherein feeding the covering blanks is performed by means of the feed unit driven by the feed actuator.

4. The method according to claim 3, wherein the control unit activates the feed actuator and the conveyor actuator in a synchronous and phase-displaced manner as a function of the phase displacement of the feed instants relative to the sequence of stops of the belt.

5. The method according to claim 3, wherein the control unit activates the feed actuator in the sequence of feed instants, which are temporally located in respective time intervals during which the belt is in motion.

6. The method according to claim 1, wherein feeding the covering blanks to the loading position of the belt is performed with the belt of the conveyor unit in motion.

7. The method according to claim 1, wherein the working data include:

a phase displacement of the feed instants relative to the sequence of stops of the belt; and a working spacing defined by a distance between two consecutive covering blanks disposed on the belt, measured in a direction of maximum extension of the belt.

8. The method of claim 1, wherein the working data include one or more of the following parameters:

a speed of the belt;

a duration of the stops of the belt;

a repetition period for the stops of the belt.

9. The method of claim 1, wherein the control unit processes the format data to set a working spacing, the working spacing defining a distance between two consecutive covering blanks disposed on the belt, measured in a direction of maximum extension of the belt.

10. The method of claim 9, wherein the control unit derives the working spacing in dependence of a distance between the positioner and the covering machine.

11. The method of claim 10, wherein the control unit derives the working spacing further in dependence of a spacing limit providing a reference value for a minimum distance along the belt between two consecutive covering blanks disposed on the belt.

12. The method of claim 1, wherein the control unit processes the format data to set the phase displacement of the feed instants relative to the sequence of stops of the belt in dependence of a distance between the feed unit and the positioner.

13. A method of producing covered cardboard boxes, the method comprising:

transporting a plurality of covering blanks from a loading position to an unloading position, by means of a conveyor unit including a belt driven intermittently by a conveyor actuator in a sequence of movements, starting at respective movement instants and alternated with corresponding stops;

picking up the covering blanks and feeding them to the loading position of the belt by means of a feed unit, in a sequence of feed instants corresponding to the sequence of movements;

receiving box blanks in an erecting machine and folding the box blanks to form corresponding boxes;

positioning each box in alignment on a corresponding covering blank disposed on the belt, at a coupling position interposed between the loading position and the unloading position;

spreading glue on one face of the covering blanks which will come into contact with a corresponding surface of the boxes to be covered;

transporting the boxes coupled to the respective covering blanks as far as the unloading position by means of the conveyor unit;

feeding the boxes coupled to the respective covering blanks to a covering machine which folds each covering blank into contact with a respective box in such a way as to cover the respective box;

adjustably setting, through a control unit, a phase displacement of the feed instants relative to corresponding movement instants of the belt;

with the control unit, receiving format data representing a format of the covering blanks, and adjusting the phase displacement of the feed instants relative to a sequence of stops of the belt;

with a first suction zone of the belt, adjacent to the feed unit, applying a first suction force on the covering blanks; and with a second suction zone of the belt, spaced from the feed unit, applying a second suction force on the covering blanks, wherein the second suction force is smaller than the first suction force.

14. A method of producing covered cardboard boxes, the method comprising:

transporting a plurality of covering blanks from a loading position to an unloading position, by means of a conveyor unit including a belt driven intermittently by a conveyor actuator in a sequence of movements, starting at respective movement instants and alternated with corresponding stops;

picking up the covering blanks and feeding them to the loading position of the belt by means of a feed unit, in a sequence of feed instants corresponding to the sequence of movements;

receiving box blanks in an erecting machine and folding the box blanks to form corresponding boxes;

positioning each box in alignment on a corresponding covering blank disposed on the belt, by a positioner at a coupling position interposed between the loading position and the unloading position;

spreading glue on one face of the covering blanks which will come into contact with a corresponding surface of the boxes to be covered;

transporting the boxes coupled to the respective covering blanks as far as the unloading position by means of the conveyor unit;

feeding the boxes coupled to the respective covering blanks to a covering machine which folds each covering blank into contact with a respective box in such a way as to cover the respective box;

adjustably setting, through a control unit, a phase displacement of the feed instants relative to corresponding movement instants of the belt;

with the control unit, receiving format data representing a format of the covering blanks; and by the control unit, adjusting the phase displacement of the feed instants relative to a sequence of stops of the belt, responsive to the format data and in dependence of the following parameters:

a distance between the feed unit and the positioner; and a distance between the positioner and the covering machine.

15. The method according to claim 14, wherein the feed unit is driven by a feed actuator, and wherein the feed actuator is separate and distinct from the conveyor actuator.

16. The method according to claim 15, wherein the control unit activates the feed actuator and the conveyor actuator in a synchronous and phase-displaced manner as a function of the phase displacement of the feed instants relative to the sequence of stops of the belt.

17. The method according to claim 15, wherein the control unit activates the feed actuator in the sequence of feed instants, which are temporally located in respective time intervals during which the belt is in motion.

* * * * *